United States Patent [19]

Studler

[11] Patent Number: 5,011,357

[45] Date of Patent: Apr. 30, 1991

[54] BOAT/AUTO PARKING SYSTEM FOR MARINA

[76] Inventor: Richard Studler, 22 Cooper St., #1, Lake George, N.Y. 12845

[21] Appl. No.: 363,984

[22] Filed: Jun. 9, 1989

[51] Int. Cl.[5] ..... E04H 6/00

[52] U.S. Cl. ..... 414/253; 114/259; 414/786; 414/264; 414/608

[58] Field of Search ..... 414/608, 228, 233, 234, 414/239, 240, 253, 264, 786; 108/55.1, 55.3; 114/259, 263

[56] References Cited

U.S. PATENT DOCUMENTS

| | | | |
|---|---|---|---|
| 2,727,638 | 12/1955 | Sestan | 414/234 |
| 3,283,933 | 11/1966 | Vander Wal | 214/620 |
| 3,348,710 | 10/1967 | James | 214/152 |
| 3,380,404 | 4/1968 | Shell | 108/52 |
| 3,393,646 | 7/1968 | Giacobe | 108/52 |
| 3,536,023 | 10/1970 | Toher et al. | 114/259 |
| 3,833,138 | 9/1974 | Dean | 214/334 |
| 4,051,787 | 10/1977 | Nishitani et al. | 108/55.3 |
| 4,059,057 | 11/1977 | Carnwath | 108/51.1 |
| 4,190,013 | 2/1980 | Otis et al. | 414/253 X |
| 4,307,985 | 12/1981 | Desprez et al. | 410/46 |
| 4,714,026 | 12/1987 | Yamaguchi et al. | 108/51.1 |
| 4,797,055 | 1/1989 | Tworoger et al. | 414/264 X |

*Primary Examiner*—H. Grant Skaggs
*Assistant Examiner*—Keith L. Dixon
*Attorney, Agent, or Firm*—Low and Low

[57] ABSTRACT

A space-saving boat and automobile parking system for marinas uniquely utilizing a pallet for sequential storage of either a boat or an automobile whereby land and space requirements for vehicular parking are significantly diminished.

16 Claims, 4 Drawing Sheets

BOAT/AUTO PARKING SYSTEM FOR MARINA

BACKGROUND OF THE INVENTION

Because of the substantial expense of maintaining dock space at marinas, and indeed the often absolute unavailability thereof, it is well known to stack or house boats on dry land in a series of vertically and horizontally arrayed "pigeon coop" nests, and then deliver the boats dockside upon demand of the owner. This is accomplished with a lift truck generally equipped with tines that are covered with padded material to prevent scratching or otherwise damaging the boat bottom.

While such nests solve the boat storage problem, they are only half the problem, the other half being the available parking at the marina for boat owners' automobiles.

Indeed, in view of limited space availability, especially in relatively urban areas, strict controls may be enforced by regulating bodies, with the number of permitted boat docks or storage positions being limited to the number of automotive parking spaces available at the marina. Furthermore, the cost of maintaining docks in the water is of itself an expensive engineering project, and further, the more docks are crowded with boat positions, the more difficult boat maneuverability becomes, and the less dockside or ramp space for lift truck or other shore-based boat handling equipment.

BRIEF SUMMARY OF THE INVENTION

This invention relates generally to the efficient use of space at a marina to permit a given area to accommodate many times the number of boats and automobiles that could otherwise be accommodated in the absence of my invention.

My invention relates to a parking system and mode of utilization characterized by the use of a pallet for combined selective use with either a boat or an automobile in conjunction with a fork lift truck to multiply the number of automobiles and boat units that may be stored in a given area.

In my improved parking system, the pallet is used in conjunction with a fork lift truck, the pallet being constructed to support, store, and transfer either a boat or an automobile, one at a time.

OBJECTS OF THE INVENTION

Accordingly, it is a first object of my invention to provide an improved parking system for boats and automobiles at a marina.

It is a further object of my invention to provide a unique space-saving system that is operable safely with boats without the necessity of padded tines on the forks of the lift truck.

It is a still further object of this invention to provide an improved space-saving parking system that multiplies the accommodation of automobile/boat combination storage facilities.

An important object of my invention is to provide a unique combination automobile/boat pallet for ready use by either in the quick and ready storage, access, delivery and discharge of a boat or an automobile in the water or on the land.

BRIEF DESCRIPTION OF THE DRAWINGS

The invention is better understood in connection with the accompanying drawings, in which.

DETAILED DESCRIPTION OF A PREFERRED EMBODIMENT OF THE INVENTION

It is the concept of my invention, as set forth in more detail hereinafter, that a boat owner will telephone his marina a predetermined time before his scheduled arrival for boat use—say one hour. The marina operator then takes his lift truck to the owner's assigned "pigeon coop" storage space, inserts the fork tines into a boat-supporting pallet according to the invention, lifts the pallet up from its supports and moves the pallet to a launching area, lowers the pallet into the water until the boat floats, and then removes the pallet.

The pallet is then taken to an automobile loading station, the owner's automobile is driven onto the pallet, secured as desired, and the lift truck then takes the auto and pallet to the assigned nest position and deposits the pallet with the automobile thereat.

Figure 3:
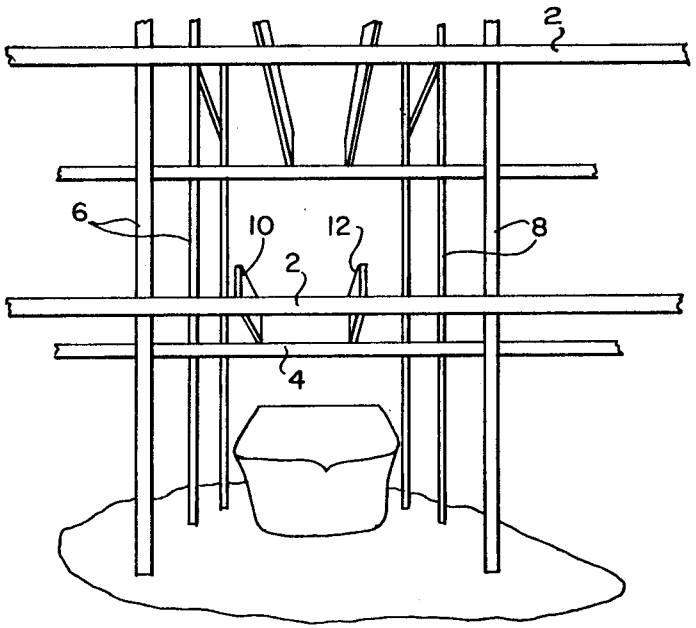
FIG. 3 is a front perspective view of a "pigeon coop" boat nest, as is known in the art.
Figure 4:
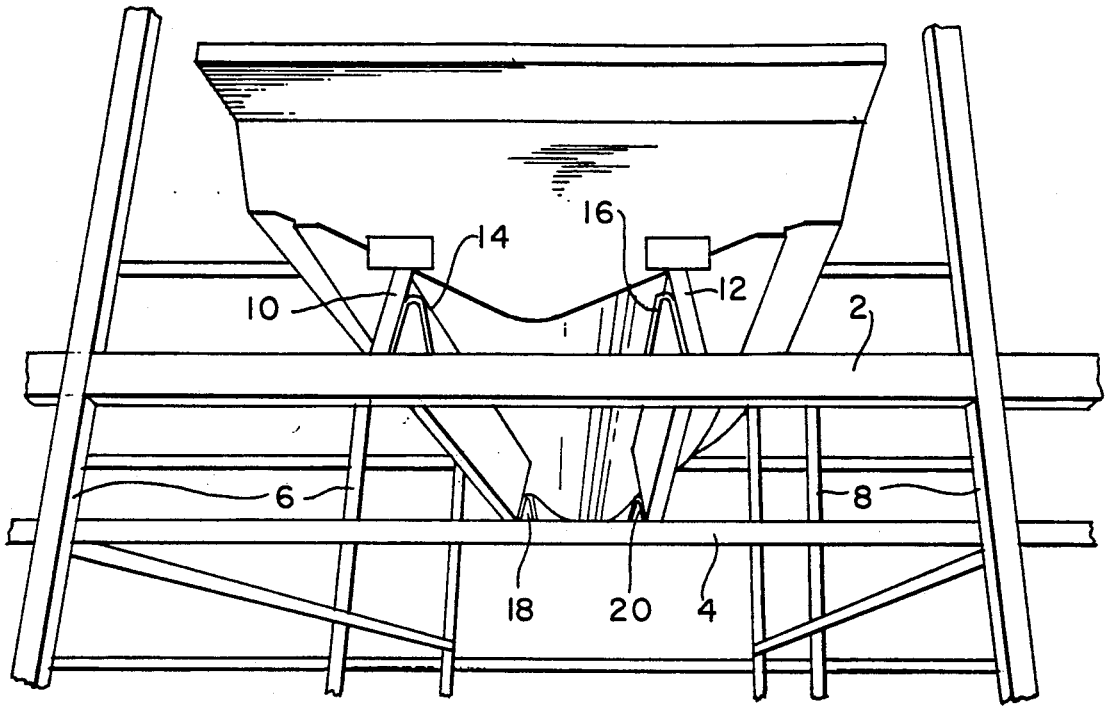
FIG. 4 is a view similar to FIG. 3 on a larger scale showing a boat conventionally supported in such a nest.

A typical pigeon coop nest is illustrated in FIGS. 3 and 4 wherein a plurality of vertical spaced supports as at 6, 8 are provided with fore-to-aft spaced lateral supports as beams 2, 4. It will be seen that vertically spaced pairs of front and rear substantially coplanar beams 2,2 and 4,4 taken with horizontally spaced pairs of vertical standards 6,6 and 8,8 define the individual nests for storage of boats, and, in my invention, automobiles. Conventionally, in each nest, a pair of laterally spaced, fore-to-aft extending boat support beams 10, 12, as wooden 2"×12"s, are provided extending between the forward and rear transverse beams 2, 4. Metal U-brackets as at 14, 16 (FIG. 4), aid in securing the support beams 10, 12. The tops of the beams may be padded, and a boat rests thereon as seen illustratively in FIG. 4.

Figure 1:
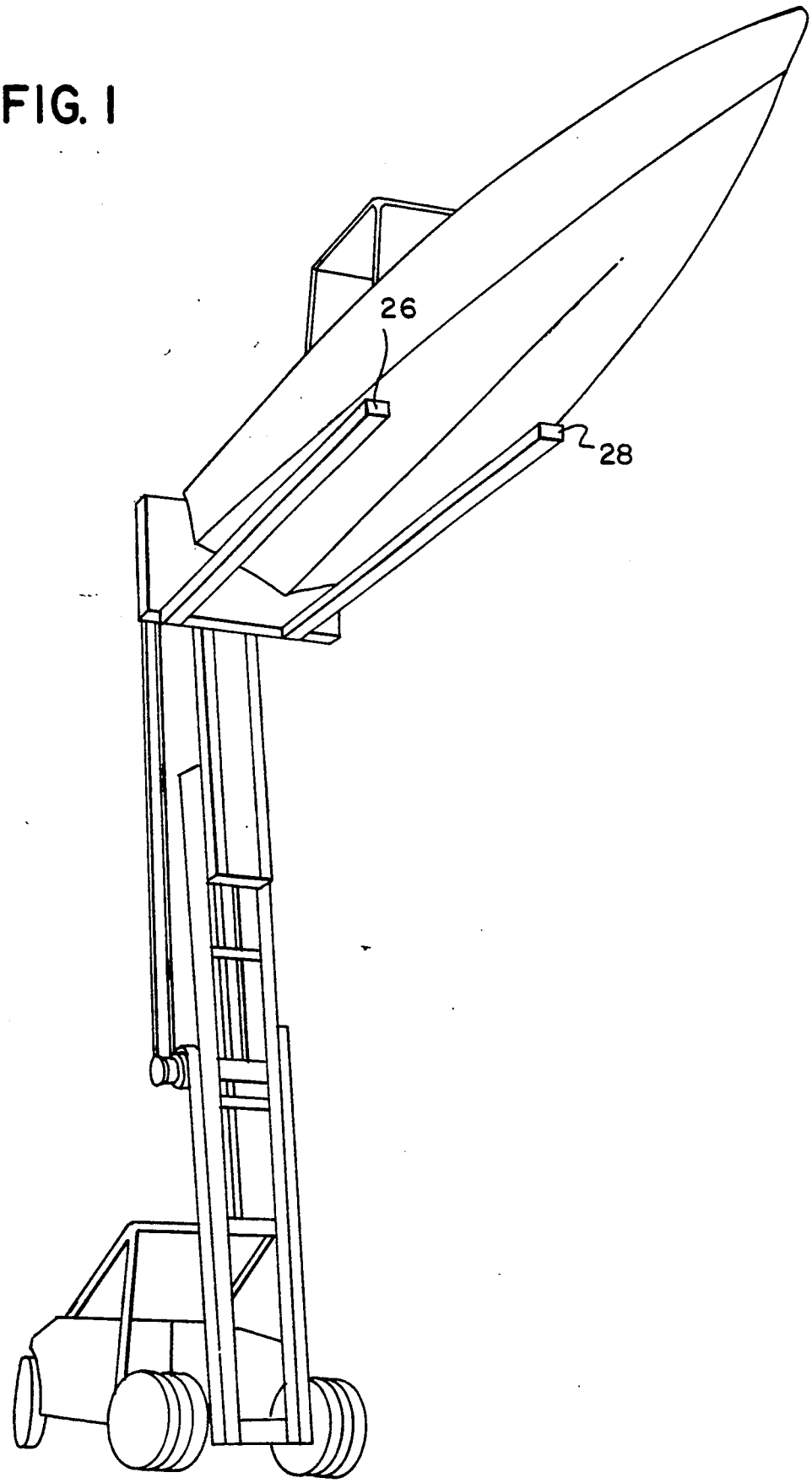
FIG. 1 is a perspective view of a boat removed from its nest and supported by a lift truck having padded tines, as is known in the art.
Figure 2:
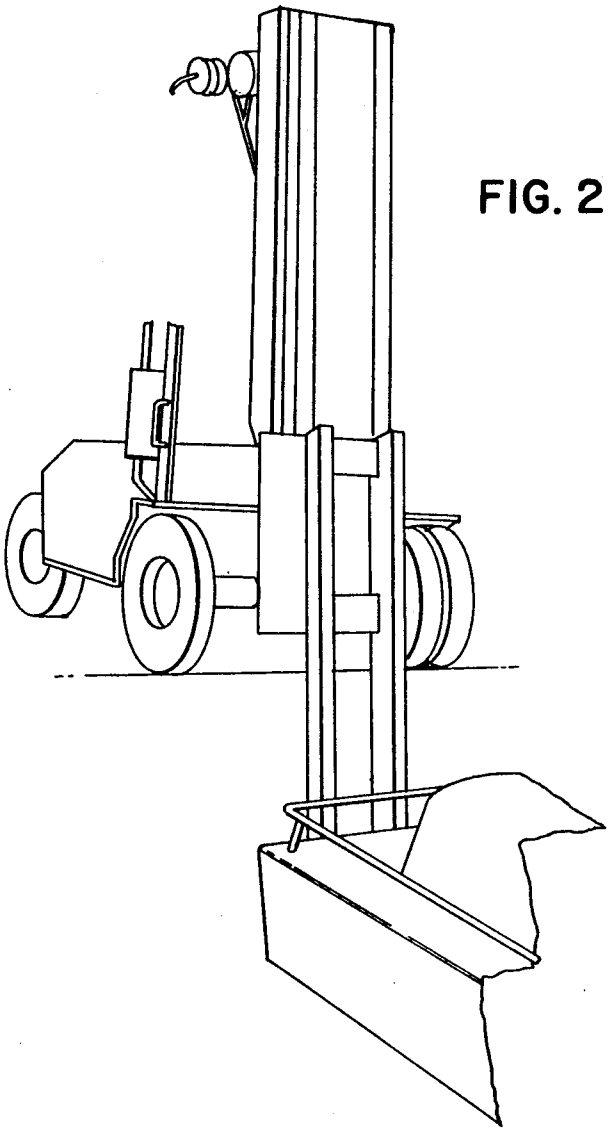
FIG. 2 is a similar perspective view, partially fragmentary, showing the lift truck fork lowered beneath the water level to deposit a boat in the water or to remove a boat from the water.

To receive the boat for use, the tines 26, 28 (FIG. 1) of a high lift truck are introduced into the nest on either side of the support beams 10, 12 beneath the hull of the boat, and then lift the boat from the storage position and deposit it in the water as seen in FIG. 2, the boat then being floated from the tines. To avoid boat damage, the tines 26, 28 are usually padded, as by carpeting or rubber.

In accordance with the present invention, padded lift truck tines are no longer necessary, and even the support beams 10, 12 in the nests may be eliminated.

Figure 5:
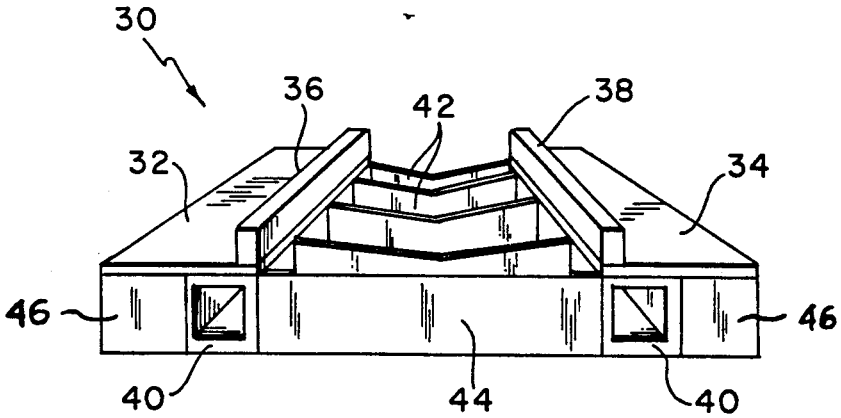
FIG. 5 is a perspective front view of a pallet in accordance with my invention to support either a boat or an automobile in a nesting parking system.
Figure 6:
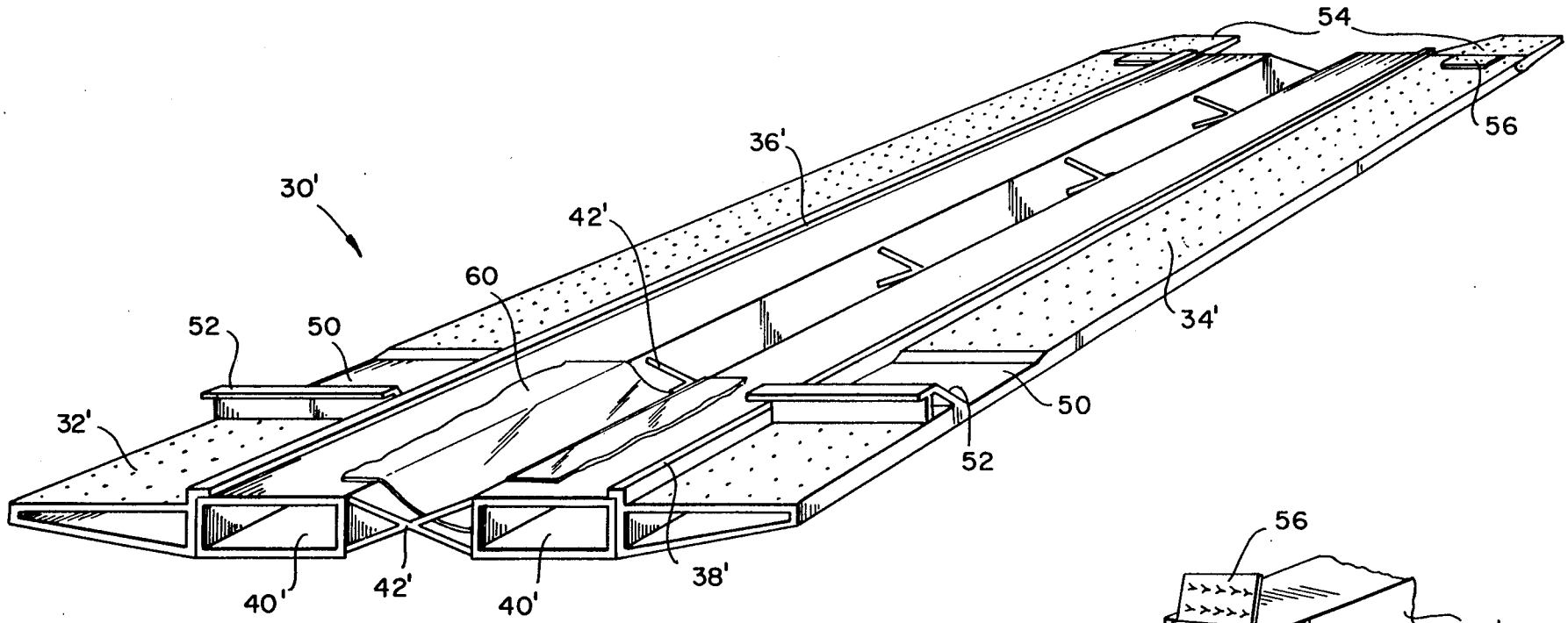
FIG. 6 is a perspective view of a preferred pallet in accordance with the invention, and, FIG. 7 is an enlarged view showing an end plate of the preferred pallet in tilted position.
Figure 7:
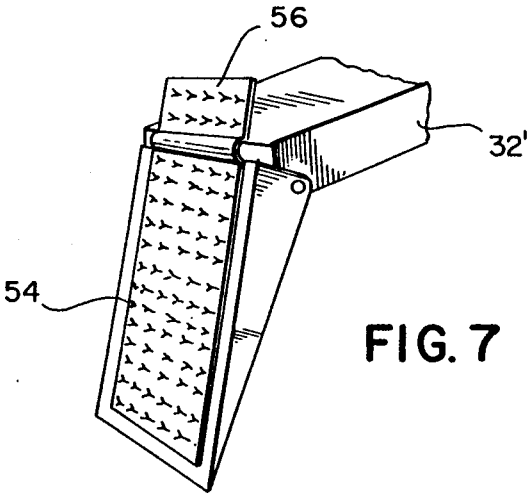

Uniquely, I provide a combination automobile and boat pallet 30 as seen in FIG. 5 and in an especially preferred form at 30' in FIG. 6. In a basic form as in FIG. 5, the pallet 30 includes a pair of elongated tubular members 40, 40, shown as essentially square, but which obviously could be generally cylindrical tubular pipe if desired. The length of the tubular members is preferably sufficient to extend somewhat more than the spacing between nest fore-and-aft transverse beams 2 and 4 so as to rest thereon and be supported thereby, whereby the hitherto employed support beams 10, 12 in the nests may be eliminated.

Associated with the tubular members 40, 40 to form the pallet 30 are a series of connecting cross members 42 which are preferably of shallow V-configuration to accommodate without interference the tapered hull of the boat toward its centerboard or shallow keel. A forward or rearmost cross connector as at 44 may or may not have the keel taper, as desired.

Primary support for and contact with a boat is provided by surmounted elongated ribs 36, 38, the top surfaces of which are preferably padded in usual manner to protect the boat. The ribs 36, 38 have disposed outwardly thereof elongated and relatively wide tread plates 32, 34 upon which are received the wheels of an automobile when driven thereon. Suitable reinforcing means as required, as additional hollow or solid beams as at 46, 46 may aid in supporting the tread plates.

As seen in FIG. 6, a further form of the pallet 30' which may be formed from aluminum extrusions and the like includes like tubular members 40', 40', connected by a plurality of welded or bolted cross braces 42', the X-configuration thereof also defining a recessed central area for the boat central hull. The comparable tread plates 32' and 34' may be similarly fabricated from aluminum or steel plates and extrusions, and may include a roughened or embossed surface to minimize slippage of a vehicle tire.

Preferably, the tread plates 32' and 34' include forward depressed wheel rests 50 and wheel stops 52, while at one end of the pallet 30' conventional hinged ramp plates 54 are provided, including a flanged extension at 56. Thus, when the pallet is lifted from the ground, the ramps will pivot downwardly, the extension 56 serving as a wheel stop at the other end of the tread plate in cooperation with wheel stops 52.

As with pallet 30, pallet 30' includes upstanding ribs at 36', 38' upon which the boat is supported. The height of these ribs may be as desired. As shown, the same are lower than the wheel stops 52, which presents no problem if the boat contact is fully received rearwardly thereof. Otherwise, in any given form for particular boats or at particular marinas, the ribs may be higher or the wheel stops may be lower in height.

In either form of the invention, the pallet may be provided with inexpensive sheet means of wood, polyethylene or the like extending between the tubular members 40, 40 or 40', 40' and beneath the cross connecting members to intercept any drippage, as oil, water, or mixtures, that may fall from either a boat or an automobile in the nest. In FIG. 6, an illustrative portion of such protective means, as a sheet of polyethylene 60, is shown extending between the tubular members.

Accordingly, with the present invention, a boat will be supported upon the pallet 30 or 30' and stored in its pigeon coop nest, the pallet resting upon the fore and aft transverse members 2, 4. In a given marina, it may be that the operator wishes to retain the previous elongated support beams 10, 12, in which case, the pallet may be deposited thereupon. It is more desirable and economic of space, however, to eliminate the support beams as unnecessary with the invention.

At launch, the lift truck will insert the fork arms 26, 28 into the tubular members 40 or 40' of the pallet, and transport the pallet and boat thereon to the water, lowering the lift arms to place the boat in the water as in FIG. 2. After the boat is floated away, the truck then lifts the pallet and takes the same to a point of arrival of the automobile of the owner. Thereat, the owner's car is driven onto the treads of the pallet, and the same lifted back into the specific nest of the owner.

It will be seen that in this manner, quite generally literally no parking space need be provided for owners' vehicles at the marina, whereby local ordinances may meet compliance and further the marina owner may even be able to increase the number of available boat storage nests.

While I have described desirable and preferred embodiments of my invention, it will be apparent that changes in the form and modifications may be made therein within the scope of the appended claims.

I claim:

1. A method for parking boats and automobiles at marinas comprising the steps of:

providing a pallet having means thereon for receiving and supporting selectively either an automobile or a boat, providing a storage area having a support structure, placing a boat upon the pallet, placing the pallet upon said support structure, removing the pallet and the boat thereon from the storage area, placing the boat and the pallet in the water, removing the boat from the pallet, placing an automobile upon the pallet, and, placing the pallet in the storage area.

2. The method of claim 1 wherein the step of providing a support structure includes the step of providing spaced forward and rear transverse supports upon which said pallet is placed.

3. The method of claim 1 wherein the step of providing said pallet includes the step of providing elongated parallel tubular members thereon for reception of the tines of a lift truck in connection with said placing steps.

4. A boat and automobile parking system for marinas comprising:

a pallet for selective reception thereon of an automobile or a boat, said pallet including a parallel spaced pair of elevated ribs for receiving a boat thereupon, and a spaced pair of tread plates outwardly thereof for receiving the wheels of an automobile driven thereon, and, means for receiving the tines of a lift truck fork for moving said pallet.

5. The system of claim 4 wherein said receiving means comprises a pair of spaced tubular members into which lift truck tines are insertable.

6. The system of claim 5 wherein said tread plates includes means for restraining rolling movement of vehicle wheels thereon when said pallet is elevated.

7. The system of claim 5 further including a storage area including means thereat for receiving and supporting a said pallet with either an automobile or a boat thereon.

8. The system of claim 7 wherein said means includes a pair of fore-and-aft transverse spaced members.

9. A space saving parking system equipped to removably store in interchangeable fashion a boat or an automobile with only one being stored in an assigned space or nest at any give time, comprising in combination, a nest having substantially coplanar front and rear horizontal support members defining the lower limit dimension of said nest, a mobile pallet device for use in said parking system with said pallet device having longitudinal and lateral dimensions suitable to fit one each into a corresponding nest and to be supported therein by the respective horizontal support members of that nest, said pallet device providing a mounting unit to support an automobile or a boat one at a time in an assigned nest, and comprising a pair of elongated channel members suitable along their longitudinal axis to receive the tines of a lift truck, said channel members being of a length to set on the front and rear horizontal supports of a nest, means fixing said channel members in spaced apart parallel relationship while permitting a boat keel or automobile undercarriage to lie without obstruction in the space between said channel members, elongated ribs affixed one each to the proximate longitudinal edges of each channel member, the said ribs functioning either to support the bottom of a boat or to guide the wheels of an automobile onto said channel members, and, the space saving parking system becoming operative when the operator of a lift truck inserts the tines of a lift truck into said elongated channel member, raises the pallet device away from the horizontal supports of that nest, delivers the pallet to a car or boat loading/unloading station, sequentially unloads one item, delivers the pallet to the next loading station, loads the next item, and then returns the pallet to its assigned nest.

10. The system of claim 9 further including drip shield means extending between said channel members to catch any dripping from either a boat or an automobile.

11. A method for interchangably parking boats and automobiles at marinas thereby maximizing utilization of available space, comprising the steps of:

providing a pallet having means thereon for receiving and supporting selectively either an automobile or a boat, placing a boat upon the pallet, placing the pallet with the boat thereon in a storage area, removing the pallet and the boat thereon from the storage area, removing the boat from the pallet and placing the boat in the water, placing an automobile upon the pallet, and placing the pallet with the automobile thereon in the storage area.

12. The interchangeable parking method of claim 11 including the further step of providing a storage area having a multilevel support structure, and wherein said automobile-and-pallet placing step includes placing said automobile and pallet in a selected position on a selected level of said multilevel support structure.

13. The interchangeable parking method of claim 12 wherein said boat-and-pallet placing step includes placing said boat and pallet in a selected position on a selected level of said multilevel support structure, and, said automobile-and-pallet placing step includes placing said automobile and pallet in said selected position and level of said storage area.

14. A method for interchangably parking boats and automobile at marinas thereby maximizing utilization of available space, comprising the steps of:

providing a pallet having means thereon for receiving and supporting selectively either an automobile or a boat, placing an automobile upon the pallet, placing the pallet with the automobile thereon in a storage area, removing the pallet and the automobile thereon from the storage area, removing the automobile from the pallet, removing a boat from the water, placing the boat upon the pallet, and, placing the pallet with the boat thereon in the storage area.

15. The interchangeable parking method of claim 14 including the further step of providing a storage area having a multilevel support structure, and wherein said boat-and-pallet placing step includes placing said boat and pallet in a selected position on a selected level of said multilevel support structure.

16. The interchangeable parking method of claim 15 wherein said automobile-and-pallet placing step includes placing said automobile and pallet in a selected position on a selected level of said multilevel support structure, and, said boat-and-pallet placing step includes placing said boat and pallet in said selected position and level of said storage area.

* * * * *